US006860696B2

(12) United States Patent
Bazan

(10) Patent No.: US 6,860,696 B2
(45) Date of Patent: Mar. 1, 2005

(54) SYSTEM AND METHOD FOR UNLOADING A VISCOUS PRODUCT FROM A BAG

(76) Inventor: Alberto Bazan, 2909 Langford Rd., 1-700, Norcross, GA (US) 30071

( * ) Notice: Subject to any disclaimer, the term of this patent is extended or adjusted under 35 U.S.C. 154(b) by 198 days.

(21) Appl. No.: 10/124,260

(22) Filed: Apr. 18, 2002

(65) Prior Publication Data

US 2003/0198545 A1 Oct. 23, 2003

(51) Int. Cl.[7] ..... F04B 43/073

(52) U.S. Cl. ..... 414/403; 414/810; 414/411; 222/386

(58) Field of Search ..... 414/403, 414, 414/785, 810, 811, 814, 411, 416.04; 222/183, 259, 261, 61, 386

(56) References Cited

U.S. PATENT DOCUMENTS 4,146,145 A 3/1979 Easton
4,209,105 A * 6/1980 Dominique ..... 220/578
4,690,172 A * 9/1987 Everett ..... 138/89
5,348,435 A 9/1994 Bissex
5,361,940 A 11/1994 Miller et al.
5,407,332 A 4/1995 Yedinak et al.
5,511,925 A 4/1996 Muth
5,517,907 A * 5/1996 Fox ..... 100/349
5,988,423 A * 11/1999 Auzureau ..... 220/233
6,254,329 B1 7/2001 Sukup et al.
6,422,430 B1 * 7/2002 Ito ..... 222/386
2001/0025864 A1 * 10/2001 Meyer ..... 222/261

* cited by examiner

*Primary Examiner*—Eileen D. Lillis
*Assistant Examiner*—Charles A. Fox
(74) *Attorney, Agent, or Firm*—Duane Morris LLP

(57) ABSTRACT

A system and method for unloading a viscous product from a bag constrained by a bin where movable scrapers are utilized to increase the amount of product evacuated from the bag, to prevent damage to the bag containing the product, and to ease removal of the pump after pumping is complete by breaking the vacuum created during pumping.

13 Claims, 3 Drawing Sheets

SYSTEM AND METHOD FOR UNLOADING A VISCOUS PRODUCT FROM A BAG

BACKGROUND OF THE INVENTION

The present invention relates to a system for evacuating a viscous product from within a plastic bag that is constrained by a bin. More specifically, the present invention relates to such a system that includes adjustable scrapers. The adjustable scrapers reduce the risk of harm to the plastic bag and once pumping is complete, ease removal from the plastic bag of the plate carrying the scrapers and the pumps.

Bin unloading systems are customarily used in the food processing and pharmaceutical industries. Viscous products such as tomato paste, icing and medical preparations are provided to manufacturers in bulk in large plastic bags which are placed within bins and subsequently unloaded by floating a platform generally referred to as a follower plate on the surface of the product and pumping the product up through the follower plate.

It is important that the evacuation of the product from the bag be complete to avoid waste. Viscous products often adhere to the bag which may collapse as the product is evacuated to overlie pockets of the product. Since gravity forces the bag to conform to the size of the bin, it is known to attach scrapers to the follower plate which extend laterally into close proximity to the bin supported bag wall to remove product clinging thereto as the product is evacuated.

However, removal of the follower plate from the unloaded bag is often problematical. The bag may collapse over the follower plate and the laterally extending scrapers may damage the bag as the follower plate is withdrawn from the collapsed bag. In addition, the upward scraping of the bag may cause product to be deposited on the top of the follower plate and/or the floor in the area around the bin, requiring cleaning to avoid health hazards and safety issues. Moreover, the product may create a seal between the scrapers and the bin supported bag, and withdrawal of the follower plate may create a vacuum which resists the withdrawal of the follower plate from the bag and/or pulls the bag from the bin as the follower plate is withdrawn.

One known system for bin unloading injects air between the plate and the bag during withdrawal of the plate to keep the bag within the bin. While the injection of air facilitates to some extent the removal of the plate from the bag; it does not address the upward scraping and/or bag damage issues. Moreover, injecting air between the plate often may not be acceptable to the food processors for other reasons.

Another known system utilizes inflatable scrapers to assist in unloading the product from the bag. Accordingly, when the plate is lowered the scrapers are inflated so that they contact the interior walls of the bag. Before the plate is withdrawn the scrapers are deflated so that they are no longer in contact with the bag, preventing the bag from being re-scraped when the plate is removed and eliminating the vacuum created during pumping. Inflated scrapers are generally not rigid enough to adequately scrape the bag and the scrapers themselves may be punctured during the scraping operation resulting in delay and down time for replacement.

Accordingly, it is an object of the present invention to obviate many of the above problems in known systems and to provide a novel system and method for unloading a viscous product contained within a bag constrained by a bin.

One embodiment of the present invention avoids the problems of the known systems by mounting movable scrapers at the edges of the plate selectively extended to remove product adhering to the interior surfaces of the bag when the plate is lowered and retracted out of contact with the interior of the bag upon withdrawal of the plate.

It is another object of the present invention to provide a novel bin unloading apparatus and method that reduces risk of injury to the bag containing a viscous product.

It is yet another object of the present invention to provide a novel bin unloading apparatus and method that eliminates the vacuum created during pumping and eases removal of a follower plate from the bag containing a viscous product.

It is still another object of the present invention to provide a novel bin unloading apparatus and method with scrapers that can be extended or retracted to vary the lateral distance between the scrapers and the bin.

It is a further object of the present invention to provide a novel bin unloading apparatus and method with scrapers that can be extended or retracted to laterally center a follower plate within the bag containing a viscous product that is constrained by a bin.

It is an additional object of the present invention to provide a novel method for maintaining a clean work area when unloading a viscous product from a bag constrained by a bin.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Like numerals represent like components throughout the several drawings.

Figure 1:
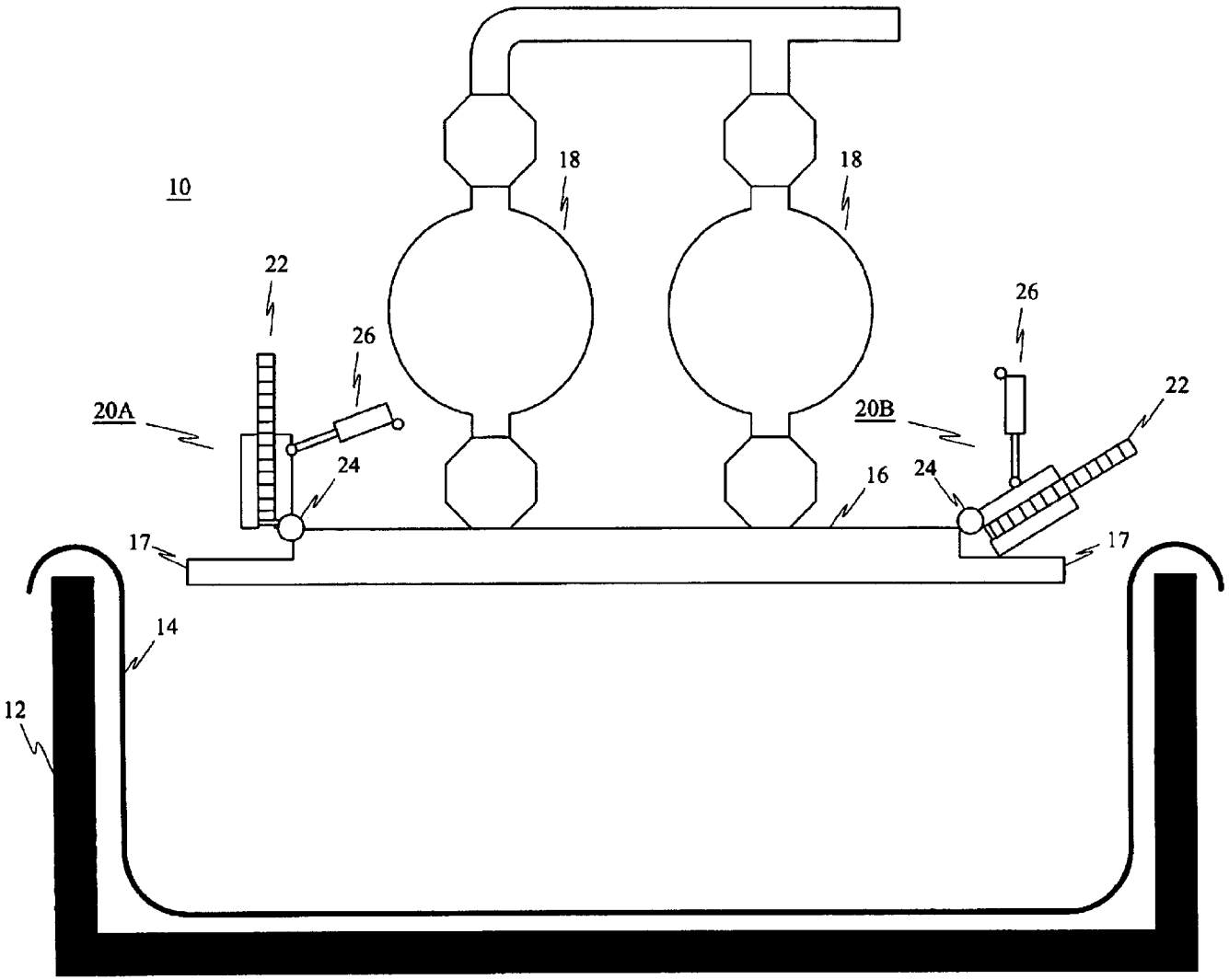
FIG. 1 is an elevation in cross-section illustrating a bin unloading system in accordance with one embodiment of the present invention.

Referring to FIG. 1, a bin unloading system 10 includes a bin 12 for constraining a bag 14 that contains a viscous product. The bin may be constructed of any material, i.e., plastic, metal or wood, that is rigid enough to withstand the pressure created when the product is pumped out of the bag 14 and to withstand the forces exerted by the weight of the product and the lateral force of the scrapers when wiping the interior of the bag 14.

Continuing with FIG. 1, the bin unloading system 10 includes a follower plate 16 of any suitable conventional material. As depicted, the plate 16 is in a rest position above the bin 12 either before or after pumping has occurred. During pumping, the follower plate 16 is lowered into the bag 14 and the pumps 18 carried by the plate 16 withdraw a viscous product out of the bag 14 through the follower plate 16. Ensuring that the maximum amount of product is evacuated from the bag scrapers 20A, 20B are provided to wipe the interior sides of the bag removing any product clinging thereto as the plate 16 is lowered within the bag 14.

Each scraper 20A, 20B may include a flexible blade 22 that contacts the interior of the bag 14 to remove any product adhering thereto. The flexible blade 22 may be made from rubber or any other conventional wiper blade material. Any means for attaching the blade 22 to the follower plate 16 may include a hinge 24 or any other suitable conventional component that permits the position of blade 22 in relation to the bag and the follower plate to be adjusted. Any actual change in the position of the scraper 22 is accomplished with an adjustment means 26 such as an air piston or the like for adjusting and maintaining the position of the scraper.

Still referring to FIG. 1, the blade 22 may adjusted to be in various other positions that are not shown. The flexible blade 22 of scraper 20A is positioned so that the blade 22 extends past the lateral edge 17 of the follower plate 16 during pumping and so that the blade 22 does not extend past the lateral edge 17 of the plate 16 upon withdrawal or initial insertion into the bag. When extended into contact with the interior sides of the bag 14, the blade 22 will scrape the bag removing any product adhering thereto when the follower plate 16 is lowered within the bag 14. By scraping the bag 14, the amount of viscous product which may be unloaded from the bag is increased. Note that the selective extension of the blades serves to keep the follower plate centered.

Figure 2:
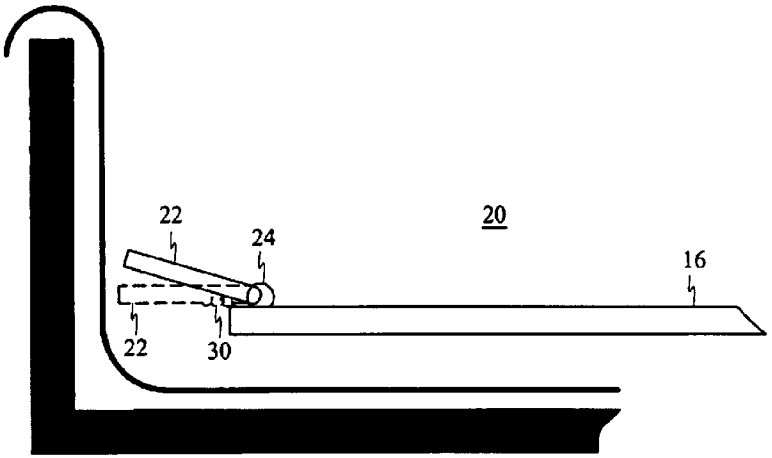
FIG. 2 is an illustration of a spring biased scraper which may be used with the embodiment of FIG. 1.

In FIG. 2, the scraper 20 includes a tension spring 30 extending between the plate 16 and the flexible blade 22. When the plate 16 is lowered into the bag 14, the viscous fluid exerts an upward force against the blade 22 that may prevent continuous contact between the blade 22 and the interior sides of the bag 14. Additionally, as the blade 22 scrapes the interior surface of the bag 14 friction exerts an upward force on the blade 22 that may also prevent continuous contact between the blade 22 and the interior sides of the bag 14. Without the requisite contact between the blade 22 and the bag 14, adequate evacuation of the product cannot be achieved. In order to counter the upward forces a spring 30 or other suitable resilient member may be included to provide a downward force on the blade 22 to ensure continuous contact between the blade 22 and the interior of the bag 14 throughout evacuation of the viscous product. The spring 30 may also assist in properly locating the plate 16 on the surface of the viscous product within the bag 14.

Figure 3:
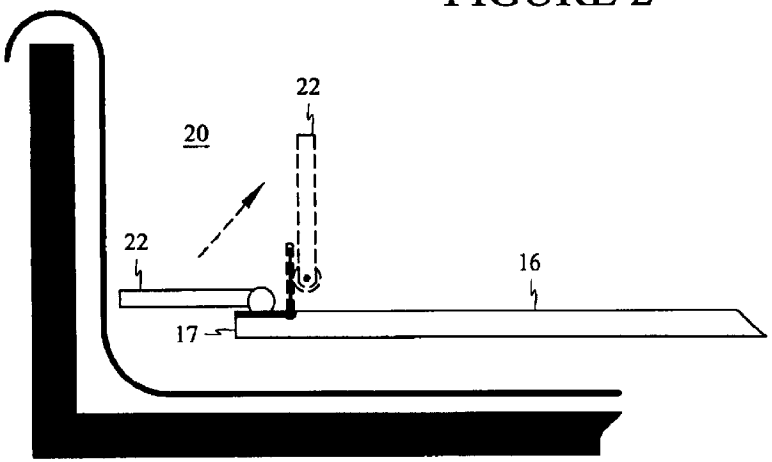
FIG. 3 is an illustration of a scraper that has been retracted so as not to extend beyond the lateral edge of the plate.
Figure 4:
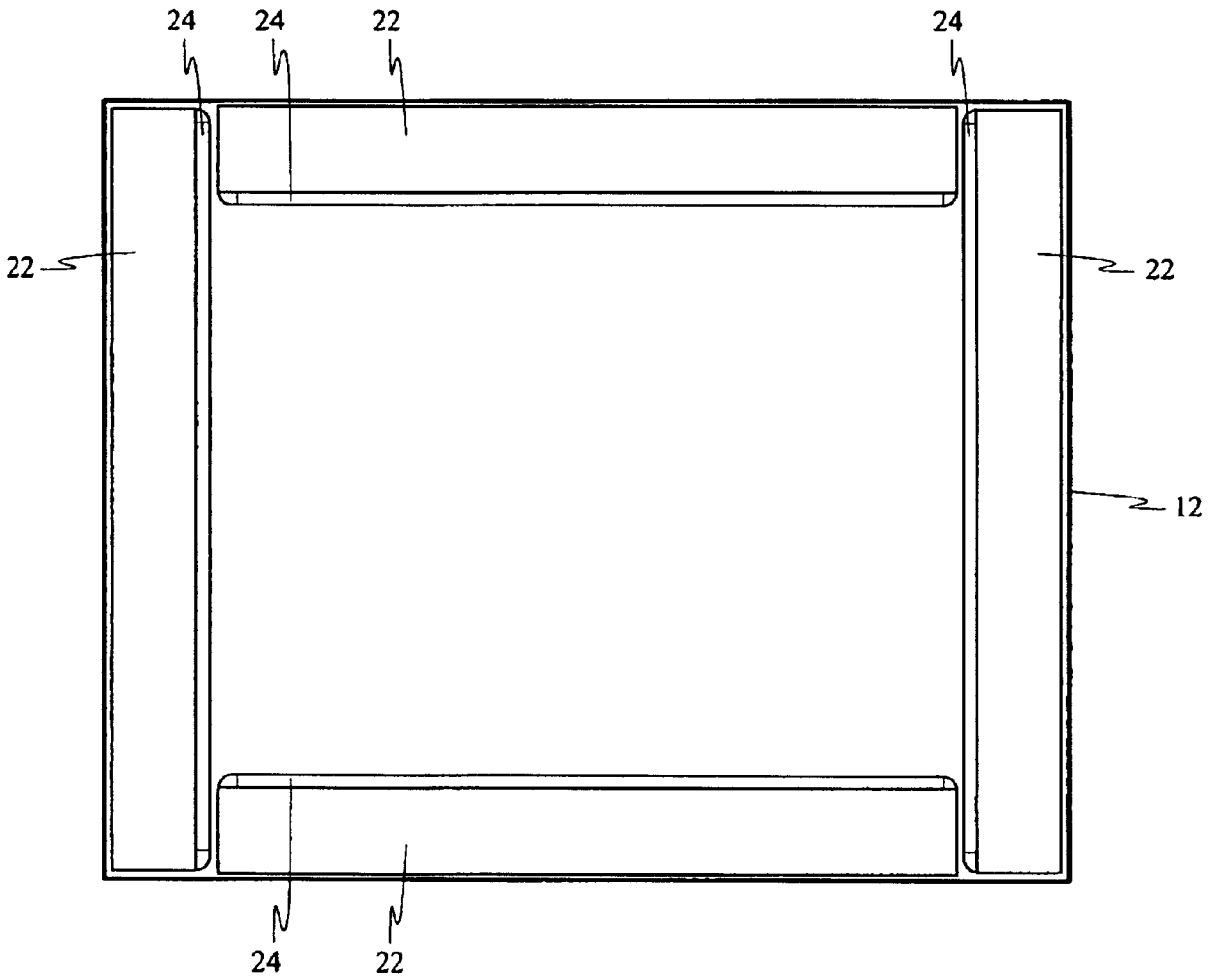
FIG. 4 is an overhead view of one embodiment of the present invention with the scrapers extended laterally.

As shown in FIG. 3, the scraper that has been retracted so as not to extend beyond the lateral edge of the plate prevents contact of the blade 22 with the interior of the bag 14. Once pumping is complete, contact between the interior sides of the bag 14 and the blade 22 may thus be eliminated to eliminate any vacuum created during pumping. This allows the plate 16 to be removed from within the bag 14 without the re-scraping and possibly damaging the bag 14. It also permits the follower plate 16 to be removed from the bag 14 without withdrawing the bag from the bin.

While preferred embodiments of the present invention have been described, it is to be understood that the embodiments described are illustrative only and that the scope of the invention is to be defined solely by the appended claims when accorded a full range of equivalence, many variations and modification naturally occurring to those of skill in the art from a perusal hereof.

What is claimed is:

1. In a bin unloading apparatus for unloading viscous product contained within a plastic bag laterally constrained by a bin, said apparatus including a follower plate adapted to overlie a substantial portion of the exposed upper surface of the product, a pump for withdrawing the product through the follower plate and a scraper carried by the follower plate for scraping product off of the interior surface of the side walls of the plastic bag as the plate is lowered within the bag and the product is withdrawn from the bag through the plate by said pump, the improvement including plural stiffly flexible scrapers and means for selectively and independently positioning said stiffly flexible scrapers in a first laterally extended position in scraping contact with the plastic bag as said plate is lowered and the product is being withdrawn therethrough and in a second laterally retracted position out of scraping contact with the plastic bag after the product is substantially removed therefrom, thereby reducing the risk of harm to the plastic bag when said follower plate is raised out of the plastic bag.

2. The bin unloading apparatus of claim 1 wherein said stiffly flexible scraper is configured to conform to the peripheral shape of the bin.

3. The bin unloading apparatus of claim 2 wherein said bin is generally rectangular.

4. A bin unloading apparatus for unloading a viscous product contained within an open plastic bag constrained by a bin, said apparatus comprising:

a bin for laterally constraining a plastic bag containing a viscous product;

a follower plate adapted to overlie a substantial portion of the exposed upper surface of a viscous product within an open bag disposed in said bin, said follower plate being shaped so that the lateral edges thereof conform generally to the shape of said bin and carrying a pump operably connected to withdraw a viscous product from the open bag therethrough;

one or more stiffly flexible scrapers carried by said follower plate adjacent the peripheral edges thereof, said one or more stiffly flexible scrapers being configured when laterally extended to scrape a viscous product off of the interior surface of a side wall of an open plastic bag when disposed within said bin; and means for selectively retracting said one or more stiffly flexible scrapers to a retracted second position out of contact with a plastic bag disposed within said bin to thereby break any vacuum created in the bag during the pumping of a viscous product out of the bag and ease removal of said follower plate from said bin after emptying the bag wherein said one or more stiffly flexible scrapers includes plural stiffly flexible scrapers; and wherein said selective retracting means includes means for retracting one of said plural stiffly flexible scrapers independently of another of said plural stiffly flexible scrapers.

5. The apparatus of claim 4 wherein said stiffly flexible scrapers are spring biased.

6. A bin unloading apparatus for unloading a viscous product contained within an open plastic bag constrained by a bin, said apparatus comprising:

a bin for laterally constraining a plastic bag containing a viscous product;

a follower plate adapted to overlie a substantial portion of the exposed upper surface of a viscous product within an open bag disposed in said bin and carrying a pump operably connected to withdraw a viscous product from the open bag therethrough; and one or more stiffly flexible scrapers carried by said follower plate adjacent the peripheral edges thereof, said one or more stiffly flexible scrapers being selectively and independently rotated to thereby vary the lateral distance from said bin.

7. A bin unloading apparatus for unloading a viscous product contained within an open plastic bag constrained by a bin, said apparatus comprising:

a bin for laterally constraining a plastic bag containing a viscous product;

a follower plate adapted to overlie a substantial portion of the exposed upper surface of a viscous product within an open bag disposed in said bin and carrying a pump operably connected to withdraw a viscous product from the open bag therethrough; and one or more stiffly flexible scrapers carried by said follower plate adjacent the peripheral edges thereof, said one or more stiffly flexible scrapers being selectively rotated to a position laterally inside the peripheral edge of said follower plate to thereby facilitate removal of said follower plate from a bag disposed within said bin.

8. A bin unloading apparatus for unloading an open plastic bag constrained by a bin, said apparatus comprising:

a bin for laterally constraining a plastic bag;

a follower plate adapted to overlie a substantial portion of the exposed upper surface of the contents of an open bag when disposed in said bin and carrying a pump operably connected to withdraw the contents of the open bag therethrough;

one or more selectively positionable stiffly flexible scrapers carried by said follower plate adjacent the peripheral edges thereof; and means for rotating said stiffly flexible scrapers.

9. The apparatus of claim 8 including means for varying the elevation of said scrapers relative to said follower plate.

10. The apparatus of claim 8 wherein said stiffly flexible scrapers are positioned by one or more air pistons relative to said follower plate.

11. A bin unloading apparatus for unloading an open plastic bag constrained by a bin, said apparatus comprising:

a bin for laterally constraining a plastic bag;

a follower plate adapted to overlie a substantial portion of the exposed upper surface of the contents of an open bag when disposed in said bin and carrying a pump operably connected to withdraw the contents of the open bag therethrough;

one or more selectively positionable stiffly flexible scrapers carried by said follower plate adjacent the peripheral edges thereof;

wherein said stiffly flexible scrapers are spring biased.

12. A method for unloading a viscous product contained within a plastic bag constrained by a bin, the method comprising the steps of:

(a) positioning a follower plate carrying stiffly flexible scrapers on the surface of a viscous product contained within an open plastic bag laterally constrained by a bin;

(b) independently rotating the stiffly flexible scrapers in position to scrape product off the interior surface of a side wall of the plastic bag as the plate is lowered into the bag bin; and (c) pumping viscous product out of the bag through the plate to thereby lower the plate within the bag, thereby unloading the viscous product from the plastic bag.

13. In a method for unloading a viscous product contained within an open plastic bag constrained by a bin by lowering a follower plate supported pump into the bag while scraping the sides of the bag with stiffly flexible scrapers carried by the follower plate, the improvement comprising the step of laterally retracting the stiffly flexible scrapers by rotational movement of the stiffly flexible scrapers sufficiently to break any vacuum created by removal of the viscous product from the bag prior to removing the follower plate from the bag.

* * * * *